US010190606B2

(12) United States Patent
Leonard

(10) Patent No.: US 10,190,606 B2
(45) Date of Patent: Jan. 29, 2019

(54) ACTUATOR FLEXIBLE MEMBER WITH REACTION FEATURE

(71) Applicant: Firestone Industrial Products Company, LLC, Indianapolis, IN (US)

(72) Inventor: Joshua R. Leonard, Noblesville, IN (US)

(73) Assignee: Firestone Industrial Products Company, LLC, Nashville, TN (US)

( * ) Notice: Subject to any disclaimer, the term of this patent is extended or adjusted under 35 U.S.C. 154(b) by 157 days.

(21) Appl. No.: 15/346,055

(22) Filed: Nov. 8, 2016

(65) Prior Publication Data

US 2017/0058919 A1 Mar. 2, 2017

Related U.S. Application Data

(63) Continuation of application No. PCT/US2015/030486, filed on May 13, 2015.

(60) Provisional application No. 61/992,610, filed on May 13, 2014.

(51) Int. Cl.
*F15B 15/10* (2006.01)

(52) U.S. Cl.
CPC ..... *F15B 15/10* (2013.01)

(58) Field of Classification Search
CPC ..... F15B 15/10; F16J 3/02; F16J 3/04; F16J 3/041; F16J 3/043; F16J 3/048
USPC ..... 92/98 R
See application file for complete search history.

(56) References Cited

U.S. PATENT DOCUMENTS 2,413,287 A * 12/1946 Bush ..... F15B 15/10 91/170 R
2,697,449 A * 12/1954 Svenson ..... F04B 11/0016 138/30
3,319,532 A 5/1967 Pridham, Jr.
3,327,322 A * 6/1967 Norton ..... A61M 1/106 417/339

(Continued)

FOREIGN PATENT DOCUMENTS

CN 101349294 A 1/2009
DE 41 21 745 A1 1/1993

(Continued)

OTHER PUBLICATIONS

Chinese Office Action including an English translation dated Sep. 21, 2017 for Chinese Application No. 2015800241782 (17 pages).

(Continued)

*Primary Examiner* — Michael Leslie
*Assistant Examiner* — Matthew Wiblin
(74) *Attorney, Agent, or Firm* — Taylor IP, P.C.

(57) ABSTRACT

An actuator includes a stiff base member defining a bottom of the actuator; a flexible member connected to the stiff base member and having a sidewall and a contact surface on top of the flexible member, the flexible member and the stiff base member defining a fluid chamber therebetween, the sidewall having a first end connected to the stiff base member and a second end, the second end and the contact surface defining a transition area therebetween, the flexible member being configured to expand when the fluid chamber is filled with fluid; and a reaction feature placed on the transition area that is configured to govern movement of the sidewall.

14 Claims, 2 Drawing Sheets

(56) References Cited

U.S. PATENT DOCUMENTS

| | | | | | |
|---|---|---|---|---|---|
| 3,534,500 | A | * | 10/1970 | Boehm | E05F 15/53 49/264 |
| 3,565,398 | A | * | 2/1971 | Floria | B66F 3/35 254/93 HP |
| 4,687,189 | A | * | 8/1987 | Stoll | B25B 5/065 269/22 |
| 4,864,918 | A | * | 9/1989 | Martin | F04B 43/0054 92/103 R |
| 4,905,575 | A | * | 3/1990 | Knecht | F01B 19/00 338/4 |
| 5,064,165 | A | * | 11/1991 | Jerman | G01L 9/0042 251/368 |
| 5,907,992 | A | * | 6/1999 | Huss | F16J 3/02 92/103 F |
| 6,398,266 | B1 | | 6/2002 | Crump | |
| 2003/0140783 | A1 | | 7/2003 | Leonard et al. | |

FOREIGN PATENT DOCUMENTS

| | | | |
|---|---|---|---|
| JP | 2003-285995 | A | 10/2003 |
| JP | 2009-248709 | A | 10/2009 |

OTHER PUBLICATIONS

Extended European Search Report dated Jan. 8, 2018 for European Patent Application No. 15 79 2695 (8 pages).

International Search Report and Written Opinion of the International Searching Authority dated Jul. 23, 2015 for International Application No. PCT/US2015/030486 (11 pages).

* cited by examiner

ACTUATOR FLEXIBLE MEMBER WITH REACTION FEATURE

CROSS REFERENCE TO RELATED APPLICATIONS

This is a continuation of PCT application No. PCT/US2015/030486, entitled "ACTUATOR FLEXIBLE MEMBER WITH REACTION FEATURE", filed May 13, 2015, which claims priority from U.S. provisional patent application Ser. No. 61/992,610, entitled "ACTUATOR FLEXIBLE MEMBER WITH REACTION FEATURE", filed May 13, 2014, which are incorporated herein by reference.

BACKGROUND OF THE INVENTION

1. Field of the Invention

The present invention relates to actuators, and, more particularly, to actuators with flexible members.

2. Description of the Related Art

Pneumatic actuators utilize pressurized gas, such as air, to push against workpieces. Pneumatic actuators are known that include a stiff base member and a flexible member connected to the base member, with an air chamber between the flexible member and stiff base member. When the air chamber fills with pressurized air, the pressure from the air forces the flexible member away from the stiff base member and allows the surface of the flexible member to produce work on a workpiece.

To prevent destruction of the pneumatic actuator, the flexible member should not be allowed to excessively expand in the radial direction due to pressurization, or else it could rupture. The sidewall stiffness of the flexible member can affect the flexible member's resistance to rupturing and is related to the flexible member's geometry, material properties, or a combination thereof. While a high sidewall stiffness of the flexible member better resists rupture, the high sidewall stiffness can cause the flexible member to have problems returning to a collapsed position when pressurization is removed. Similarly, if the sidewall stiffness is too high, high stresses can be developed in the flexible member which lead to durability issues.

What is needed in the art is an actuator with a flexible member that can overcome some of the previously described disadvantages.

SUMMARY OF THE INVENTION

The present invention provides an actuator with a flexible member that has a reaction feature which governs the flexible member's sidewall movement while maintaining appropriate levels of sidewall stiffness.

The invention in one form is directed to an actuator including a stiff base member defining a bottom of the actuator; a flexible member connected to the stiff base member and having a sidewall and a contact surface on top of the flexible member, the flexible member and the stiff base member defining a fluid chamber therebetween, the sidewall having a first end connected to the stiff base member and a second end, the second end and the contact surface defining a transition area therebetween, the flexible member being configured to expand when the fluid chamber is filled with fluid pressure; and a reaction feature placed on the transition area that is configured to govern movement of the sidewall.

The invention in another form is directed to an actuator including a base; a flexible member connected to the base, the flexible member having a sidewall and a contact surface, an area between the sidewall and the contact surface defining a transition area; and a reaction feature placed on the transition area that is configured to govern movement of the sidewall.

An advantage of the present invention is that it provides a reaction feature which can help return the flexible member to its collapsed position.

Another advantage is that the reaction feature can help the sidewall resist pivoting about the transition area.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
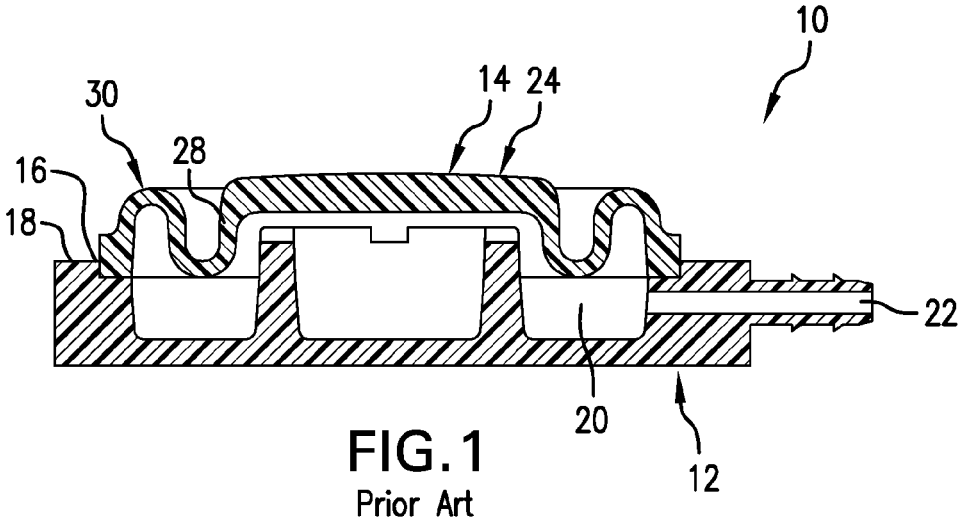
FIG. 1 Prior Art
FIG. 1 is a perspective view of an actuator known in the prior art in a collapsed position.
Figure 2:
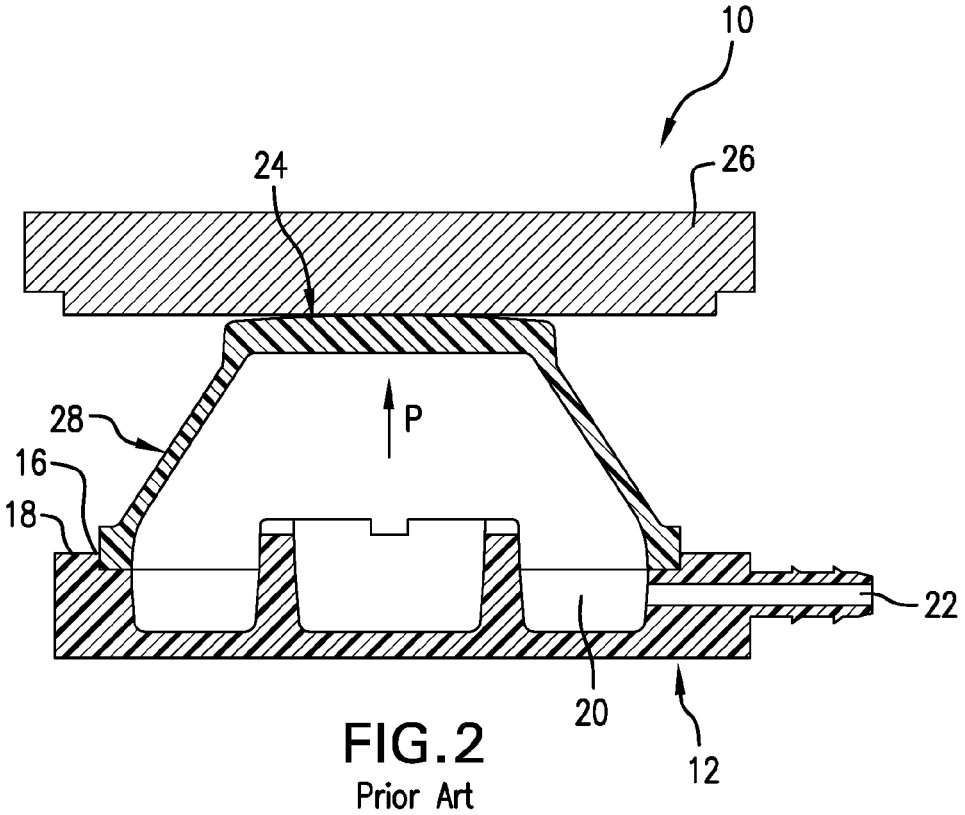
FIG. 2 Prior Art
FIG. 2 is a perspective view of an actuator known in the prior art in an expanded position.

Referring now to the drawings, and more particularly to FIGS. 1 and 2, there is shown an actuator 10 that is known in the prior art and which generally includes a stiff base 12 and a flexible member 14 connected to the stiff base 12. The flexible member 14 is connected to the stiff base 12 by a joint 16 formed on an edge 18 of the stiff base 12. A fluid chamber 20 is formed between the stiff base 12 and flexible member 14. An opening 22 formed in the stiff base 12 allows for fluid to enter and exit the fluid chamber 20. The fluid exerts a pressure, shown as arrow P in FIG. 2, that extends the flexible member 14 away from the stiff base 12.

The flexible member 14 is generally cylindrical in shape and has a contact surface 24 on its top that can produce work on a workpiece 26 when fluid pressure expands the flexible member 14 away from the stiff base 12. The flexible member 14 has a sidewall 28 that has convolutions 30 when the actuator 10 is in a collapsed state (as shown in FIG. 1). When the actuator 10 is in the expanded state (as shown in FIG. 2), which is caused by fluid pressure P, the convolutions 30 approach the profile of the sidewall 28 as it straightens to expand its length and push the contact surface 24 against the workpiece 26.

Figure 3:
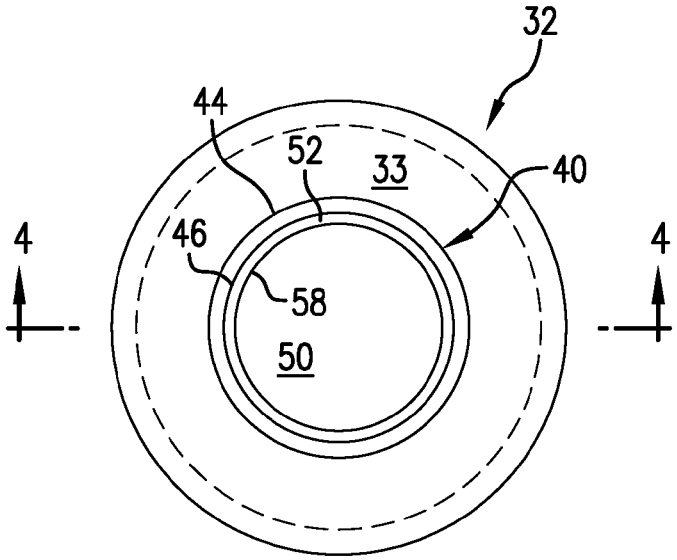
FIG. 3 is a top view of an embodiment of an actuator formed according to the present invention.

Referring now to FIG. 3, an embodiment of an actuator 32 including a flexible member 40 formed according to the present invention is shown. The actuator 32 shown in FIG. 3 can be structured similarly to the actuator 10 shown in FIGS. 1-2, with flexible member 40 replacing the flexible member 14 shown in FIGS. 1-2.

Figure 4:
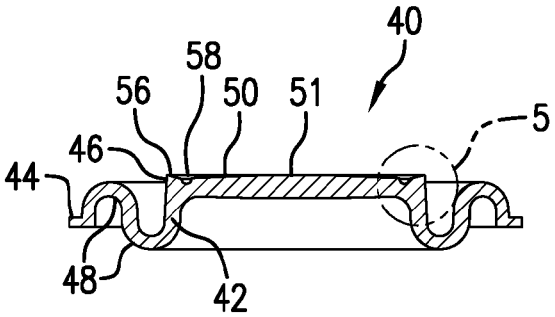
FIG. 4 is a cross-sectional view of the flexible member shown in FIG. 3 taken along line 4-4.

Referring now to FIG. 4, a cross-section of an embodiment of the flexible member 40 of the actuator 32 shown in FIG. 3 is illustrated separate from the actuator 32. The flexible member 40 includes a sidewall 42 that has a first end 44 that connects to a stiff base member 33 of the actuator 32, which can define the actuator's bottom, and a second end 46 at the top of the sidewall 42. The flexible member 40 shown in FIG. 4 is in the contracted state and has convolutions 48 that arise in the sidewall 42 as a result of being contracted. These convolutions 48 can be absent in the sidewall 42 when the actuator 32 is in an expanded state. The flexible member 40 has a contact surface 50, which will produce work against a workpiece when the actuator 32 is in the expanded state. The contact surface 50, unlike the sidewall 42, will generally stay the same shape regardless of whether the actuator 32 is in an expanded or contracted state. As can be seen, the contact surface 50 can be angled to produce a top surface 51 that will be the furthest part of the contact surface 50 from the bottom of the actuator 32 and be the primary surface of contact with an actuated workpiece. A transition area 52 is defined between the second end 46 of the sidewall 42 and the contact surface 50. The transition area 52 can be defined between a top edge 54 of the flexible member 40 and the contact surface 50. A reaction feature 56, shown in greater detail in FIG. 5, is placed on the transition area 52 and governs sidewall 42 movement and stiffness.

Figure 5:
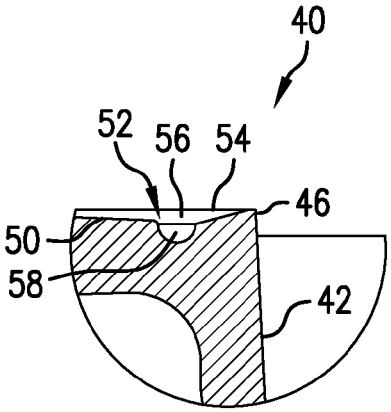
FIG. 5 is a close-up perspective view of the flexible member shown in FIGS. 3-4.

Referring now to FIG. 5, the reaction feature 56, as shown, can be a protrusion of material of the sidewall 42 that is shaped as a wedge that follows the perimeter of the top edge 54. The reaction feature 56 can have a material distribution that changes across the transition area 52, such that the material distribution of the reaction feature 56 is greatest near the top edge 52 and decreases as it approaches the contact surface 50. When pressure is created in the fluid chamber, the flexible member 40 expands so that the contact surface 50 and reaction feature 56 press against an actuated workpiece, with the majority of the contact between the flexible member 14 and the actuated workpiece occurring at the top surface 51. At high enough pressure, the portion of the sidewall 42 near the top edge 52 attempts to pivot about the transition area 52 as a result of pressure in the fluid chamber pushing on the flexible member 40, causing expansion, and the expansion being constrained about the top surface 51 by force from the actuated workpiece. As the material of the flexible member 40 expands and attempts to pivot about the transition area 52, the reaction feature 56 can come into contact with the actuated workpiece and force created by the actuated workpiece pushing on the reaction feature 56 impedes pivoting of the sidewall 42 near the top edge 54 and also helps to push the flexible member 40 back to its collapsed position when pressure in the fluid chamber is removed. In this sense, the reaction feature 56 governs sidewall 42 movement by impeding pivoting as the flexible member 40 expands and pushing the flexible member 40 back to its collapsed position as pressure is removed. A recess 58 can be formed on top of the flexible member 40 between the transition area 52 and top surface 50 to reduce the chance of creating a heat sink during production of the flexible member 40. As can be seen, the recess 58 can also serve as a boundary between the transition area 52 and top surface 50. The flexible member 40 of the present invention can be formed of any material that can sufficiently expand and collapse to actuate a workpiece, such as flexible polymers.

While the reaction feature 56 is shown as being an integral part of the sidewall 42, it is also contemplated that the reaction feature 56 is included as a part of the actuated workpiece or as a separate piece that rests on the transition area 52. The reaction feature 56 can be continuous along its length and/or width or be segmented to alter the force distribution that is applied to the transition area 52. The reaction feature 56 does not need to be placed on the entire transition area 52 between the sidewall 42 and the contact surface 50, but can be placed on sections of the transition area 52 where pivoting about the transition area 52 is likely to occur and/or collapsing of the flexible member 40 is hindered. The reaction feature 56 can be made of the same material as the sidewall 42 or different materials that can sufficiently apply force to collapse the flexible member 40 and/or hinder pivoting about the transition area 52.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An actuator, comprising:

a stiff base member defining a bottom of said actuator;

a flexible member connected to said stiff base member and having a sidewall and a contact surface on top of said flexible member, said flexible member and said stiff base member defining a fluid chamber therebetween, said sidewall having a first end connected to said stiff base member and a second end, said second end and said contact surface defining a transition area therebetween, said flexible member being configured to expand when said fluid chamber is filled with fluid;

a reaction feature placed on said transition area that is configured to govern movement of said sidewall; and wherein said flexible member has a recess formed between said reaction feature and said contact surface.

2. The actuator according to claim 1, wherein said reaction feature is a mass of material.

3. The actuator according to claim 2, wherein said mass of material is a protrusion of said sidewall.

4. The actuator according to claim 2, wherein said mass of material has a material distribution across said transition area, said material distribution being higher in an area adjacent to said second end than in an area adjacent to said contact surface.

5. The actuator according to claim 2, wherein said flexible member has a recess formed between said transition area and said contact surface, said recess defining a boundary between said transition area and said contact surface.

6. The actuator according to claim 1, wherein said flexible member and said reaction feature are formed of the same material.

7. The actuator according to claim 1, wherein said reaction feature is integrally formed with said flexible member.

8. An actuator, comprising:

a base;

a flexible member connected to said base, said flexible member having a sidewall and a contact surface, an area between said sidewall and said contact surface defining a transition area;

a reaction feature placed on said transition area that is configured to govern movement of said sidewall; and wherein said flexible member has a recess formed between said reaction feature and said contact surface.

9. The actuator according to claim 8, wherein said reaction feature is a mass of material.

10. The actuator according to claim 9, wherein said mass of material is a protrusion of said sidewall.

11. The actuator according to claim 9, wherein said mass of material has a material distribution across said transition area, said material distribution being higher in an area adjacent to a second end than in an area adjacent to said contact surface.

12. The actuator according to claim 9, wherein said flexible member has a recess formed between said transition area and said contact surface, said recess defining a boundary between said transition area and said contact surface.

13. The actuator according to claim 8, wherein said flexible member and said reaction feature are formed of the same material.

14. The actuator according to claim 8, wherein said reaction feature is integrally formed with said flexible member.

* * * * *